United States Patent [19]

Bresin et al.

[11] 4,439,654

[45] Mar. 27, 1984

[54] WATERPROOF CONTROL KNOB ASSEMBLY WITH INTEGRAL SWITCH

[75] Inventors: Mark S. Bresin, Coral Springs; Peter B. Gilmore, Miami, both of Fla.

[73] Assignee: Motorola, Inc., Schaumburg, Ill.

[21] Appl. No.: 426,334

[22] Filed: Sep. 29, 1982

[51] Int. Cl.[3] ..... H01H 13/06; H01H 19/28

[52] U.S. Cl. ..... 200/302.1; 200/155 R; 200/264; 200/159 B; 338/163; 338/198

[58] Field of Search ..... 200/302, 155 R, 156, 200/264, 296, 159 B, 336, 6 A, 340; 338/162, 163, 164, 198, 200

[56] References Cited

U.S. PATENT DOCUMENTS

| | | | |
|---|---|---|---|
| 3,244,822 | 4/1966 | Elliott | 200/156 X |
| 3,728,511 | 4/1973 | George et al. | 200/296 X |
| 3,735,068 | 5/1973 | Yanaga et al. | 200/159 B |
| 3,742,165 | 6/1973 | Hellman | 200/302 X |
| 3,863,039 | 1/1975 | Tygard et al. | 200/155 R X |
| 4,110,721 | 8/1978 | Nakanishi et al. | 388/162 |
| 4,237,629 | 12/1980 | Schmidt | 200/6 A X |
| 4,298,778 | 11/1981 | Beresford-Jones | 200/302 |

OTHER PUBLICATIONS

K. B. Denver, Inc., "Keyboards–Snap Dome Switches" Sales Pamphlet.

*Primary Examiner*—Stephen Marcus
*Assistant Examiner*—Ernest G. Cosick
*Attorney, Agent, or Firm*—Jerry A. Miller; Joseph T. Downey; Edward M. Roney

[57] ABSTRACT

A rotatable control with an integral switch comprises conductive inner and outer shaft in a concentric configuration. The inner and outer shaft are electrically insulated from one another and frictionally coupled to allow concentric simultaneous rotation. The assembly is covered with a flexible insulating shroud which has a switch contact located on the upper interior surface thereof. Conductive spring members are clipped around the lower portion of the inner and outer shaft to allow electrical connection to a circuit board.

11 Claims, 3 Drawing Figures

WATERPROOF CONTROL KNOB ASSEMBLY WITH INTEGRAL SWITCH

BACKGROUND OF THE INVENTION

1. Field of the Invention

This invention relates generally to the field of controls for electronic equipment and more particularly to waterproof rotatable controls which are protected from overtorquing and contain an integral momentary contact switch.

2. Background of the Invention

As the state of the art in the electronic industry progresses, the obvious trend is towards smaller and smaller electronic devices which must reliably perform more and more functions. An excellent example of this trend is in the field of electronic calculators. While the predecessor of the modern pocket calculator literally occupied rooms devices now exist with similar computational power which will fit in a shirt pocket. These devices typically have control buttons which electronically address a number of different features per button in order to provide the user with a large number of features in a small package. This is accomplished electronically however rather than electro-mechanically.

Similar progress is taking place in the field of portable ratios and pagers. As the size of these devices diminishes, the number of control features incorporated in a single control knob must increase in order for the user to control the additional electronic features incorporated therein. Smaller portable two-way radio designs must to either decrease the size of these electromechanical controls to the point of being difficult to use or incorporate a number of these functions in a single control.

While the state of the art trend is towards smaller size, the need for durability and reliability in harsh artificial and natural environments is ever increasing. One of the more frequent consumer demands is for a radio which is impervious to water and rain damage. The control panel of a two-way radio or similar equipment is especially susceptible to becoming the point of entry for water and rain. The long felt need for a waterproof two-way radio is evidenced by the great commercial success of products such as the Motorola HT 440 Waterproof Portable Two-Way Radio.

Another durability and reliability problem which is frequently encountered in the field of two-way portable radios is that of damage to potentiometers caused by the user overtorquing control knobs. For electrical, size, and cost considerations, it is desirable to use physically small potentiometers and switches to control radio funtions, such as volume and squelch. These smaller potentiometers, however, are normally more fragile than larger potentiometers. Therefore, as product size decreases and the demand for reliability increases the need to protect these potentiometers from overtorquing damage is amplified.

In attempting to attain all of the above goals, severe technical difficulties are encountered when conventional design approaches are utilized. Such a conventional approach to obtaining the combined rotary function with a momentary switch might entail spring loading the control knob so the user would indirectly actuate a separate momentary switch by pressing the entire knob inward. It is known in the art to effect the combination of conventional push on/push off switches with rotary knobs in this manner. However, water sealing such an assembly without sacrifice in reliability becomes next to impossible. Such a design would probably require the control's shaft to slide longitudinally through an O-ring seal. It is well known that this type of movement produces shear stresses in the O-ring and induces failure of the seal after very few operations. In addition, the force required to operate such a control and the spring pressure required to return such a control to its original position would be excessively high and would translate into greater expense and highly inefficient utilization of space due to thicker housing walls, more support structures, etc.

Since it is also desirable to electrically insulate the control to prevent corrosion, and to incorporate overtorquing protection, the above approach is totally unsatisfactory.

SUMMARY OF THE INVENTION

It is an object of the present invention to provide an improved rotatable switch assembly.

It is another object of the present invention to integrate a plurality of switching and control functions in a single control knob.

It is another object of the present invention to integrate a rotatable switch assembly with a waterproof control knob which drives a potentiometer.

It is another object of the present invention to provide a reliable waterproof rotatable switch assembly integrated into a control knob with a clutching mechanism to protect a potentiometer against overtorquing.

It is a further object of the present invention to provide a reliable waterproof control knob for two-way portable radios which integrates the on/of function, volume function, and squelch monitor function all in a single control which may not be damaged by overtorquing.

These and other objects of the invention will become apparent to those skilled in the art upon consideration of the following description of the invention.

The present invention is directed towards a rotatable switch integrated within a potentiometer control knob which comprises a conductive inner shaft having upper and lower portions. A conductive outer shaft is concentric with the inner shaft and has upper and lower portions corresponding to those of the inner shaft. The outer shaft is adapted to be sealed to a panel with an O-ring. The outer and inner shafts are electrically insulated from one another. The inner shaft and outer shaft are mechanically coupled to one another to permit the concentric rotation of both shafts simultaneously. A switch contact is located adjacent an insulating shroud which covers the upper portions of the shafts. This contact electrically couples the inner and outer shafts when the switch is actuated.

The features of the invention believed to be novel are set forth with particularity in the appended claims. The invention itself however, both as to organization and method of operation, together with further objects and advantages thereof, may be best understood by reference to the following description taken in conjunction with the accompanying drawings.

DESCRIPTION OF THE PREFFERED EMBODIMENT

In accordance with the previously stated objectives, it is desirable to produce a waterproof multi-function control which includes a clutch mechanism to prevent overtorquing damage to an associated potentiometer. When embodied in a portable two-way radio the control could serve as an on/off switch, a variable potentiometer preferrably to serve as a volume control, and a momentary contact switch. The momentary contact switch could serve a plurality of functions, probably the most useful of which would be a squelch monitor switch. That is, when the user wants to momentarily monitor radio activity on the channel prior to a transmission, or for some other reason desires to open the squelch in his radio, he would actuate the monitor switch which would enable his receiver's audio. This embodiment however, is only presented by way of an example and is not intended to be limiting.

Figure 1:
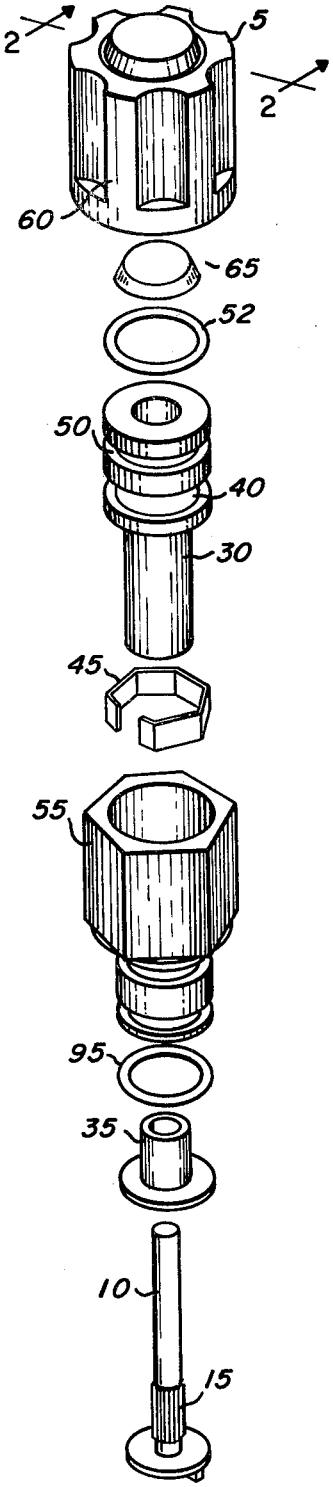
FIG. 1 is an exploded view of the control knob assembly which more clearly shows the preferred shape of each component of that assembly.
Figure 3:
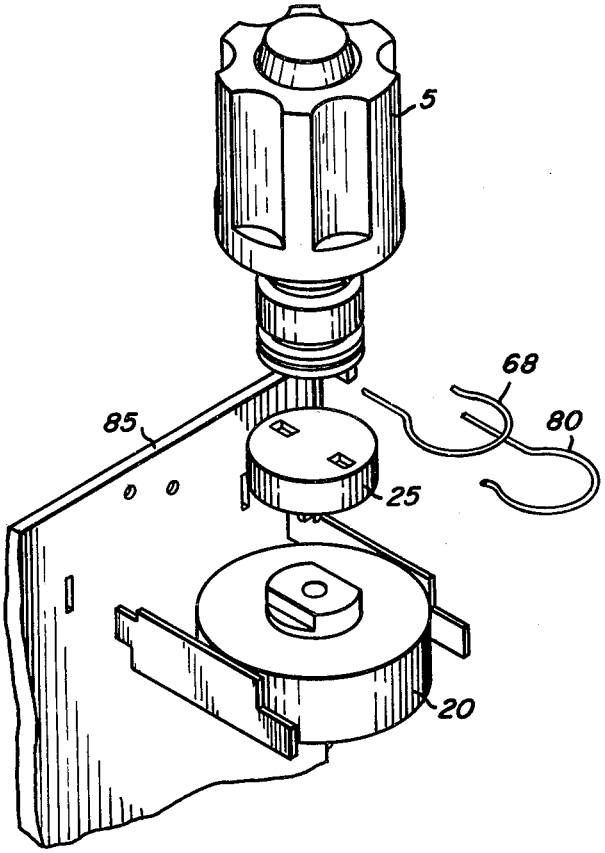
FIG. 3 is an exploded view of the control knob assembly as it interfaces to the potentiometer and circuit board and more clearly shows the preferred shape of the conductive spring members.
Figure 2:
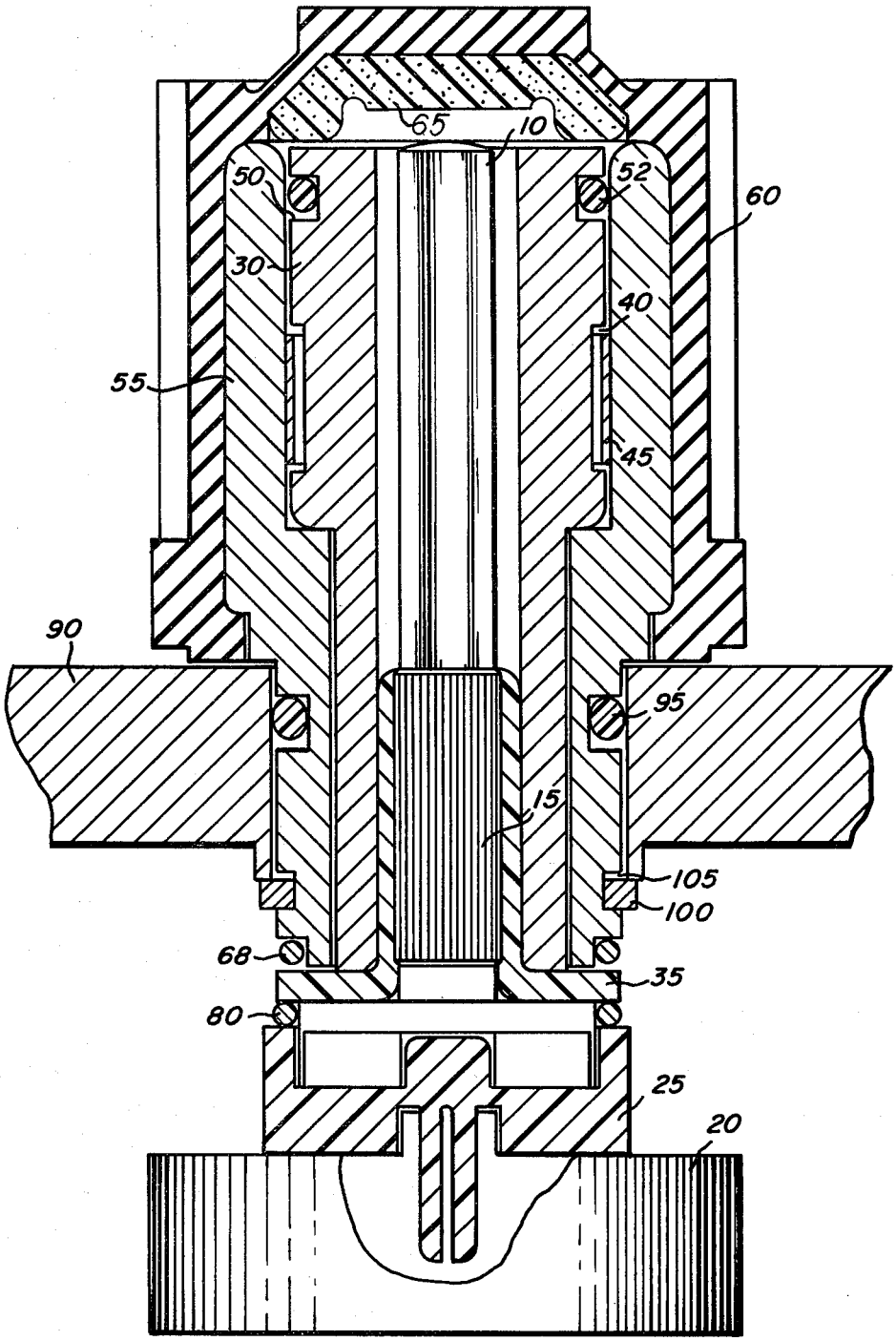
FIG. 2 is a partial cross-sectional view of the control knob assembly of the present invention.

The mechanical construction of the present invention is best understood by reference to FIG. 1 in conjunction with FIGS. 2 and 3. FIG. 2 is a sectional view of a control knob 5 taken along 2—2 which serves to illustrate the relative positions of the associated components when the control knob is assembled. FIGS. 1 and 3 are exploded views which more clearly show the relative arrangement of the various components in the assembly.

A central conductive inner shaft 10 which is preferrably of tin plated nickel-silver runs along the central axis of the control knob 5. Near the lower end, its diameter increases slightly to form a ribbed portion shown as textured area 15. The lower end of the inner shaft is configured in a flanged manner to enable it to drive the shaft of a potentiometer 20. In the embodiment shown this is accomplish by first interfacing the end of the inner shaft to an insulated drive bushing 25 and in turn interfacting drive bushing 25 to the shaft of potentiometer 20 but this is not intended to be limiting. In the preferred embodiment, drive bushing 25 is made of glass filled nylon.

A conductive intermediate shaft 30 having a longitudinal bore is disposed concentrically about inner shaft 10 and is preferrably composed of stainless steel. Intermediate shaft 30 is insulated from inner shaft 10 by an insulator bushing 35 substantially surrounding the textured portion of inner shaft 10. During assembly, the insulator bushing is preferrably press-fitted between the inner shaft 10 and the intermediate shaft 30 to form a very tight bond. The textured area 15 of the inner shaft 10 tightly locks the insulator bushing 35, which is preferrably composed of glass filled-nylon or a similar material, and fixed the physical relationship between the two shafts. It will be evident to those skilled in the art that other configurations of insulator spacers or bushings will equally well serve the same purpose of insulating and fixing the physical relationships of the inner and intermediate shafts.

As shown in the drawings (FIG. 1 & FIG. 2), this intermediate shaft 30 would preferrably contain a slot 40 cut or molded circumferrentially around the outer surface of the intermediate shaft 30. Slot 40 accepts a metallic clutch band 45 which is more clearly shown in FIG. 2. Clutch band 45 is preferrably made of tin plated berylium copper for its high tensile and yield strength and formed into a polygonal shape. An open hexagon has been found satisfactory. This metallic spring material allows the open side to be expanded to slip within slot 40 and is resilient enough to substantially return ot its original polygonal shape after insertion in the slot.

A second circumferrential slot 50 is disposed along the outer surface of intermediate shaft 30 in a similar manner to that of slot 40. Slot 50 is designed to accept a rubber O-ring 52 which provides a secondary water seal to the internal mechanism of the control and prevents water from entering the radio as will be described later.

Prior to press-fitting inner shaft 10 and intermediate shaft 30 together with insulator bushing 35, clutch band 45 and O-ring 52 are installed on the intermediate shaft 30. This sub-assembly is then inserted into the longitudinal bore of an outer shaft 55 to form a watertight assembly by compressing O-ring 52 between the inner wall of slot 50 and the inner wall of outer shaft 55 which is also preferrably of stainless steel. Some lubrication of the O-ring may be desirable to simplify assembly. Clutch band 45 is also compressed during this assembly process so that the corners of the polygon are in contact with the outer shaft 55 and the central area of each side of the polygon is in contact with the intermediate shaft 30. This forms a frictional coupling between the intermediate shaft 30 and the outer shaft 55 by virtue of the compressed spring action of clutch band 45. Since clutch band 45 is comprised of a conductive metal it also places outer shaft 55 and intermediate shaft 30 in electrical contact with one another.

It will be evident to one skilled in the art that relative longitudinal displacement of each of the shafts relative to the other will be difficult once this subassembly has been press fitted together. It is also evident that in the alternative the intermediate shaft 30 may be press-fitted to the outer shaft 55 rather than inner shaft 20 and the inner shaft 10 may be mechanically and electrically coupled to the intermediate shaft 30 by the clutch band 45. That is, the relative positions of the clutch band 45 and insulator bushing 35 may readily be interchanged by one skilled in the art with only minor modifications without departing from the spirit of the invention.

The upper portion of this entire sub-assembly is enclosed by an insulating boot-like shroud 60 which is preferrably comprised of an elastomeric or silicone rubber material such as neoprene, silicone or urethane rubber. This shroud 60 is streched over the assembly and is held firmly in place by the resilient properties of the shroud itself. A lip at its lower end mates with the inward contour of outer shaft 55. Various adhesives may also be used to more firmly lock the shroud to outer shaft 55 while allowing rotation relative to the control panel. The polygonal shape of the outer shaft mating with a similar polygonal shape of the inside of the insulating shroud 60 prevents independent rotation of the shroud 60 and the outer shaft 55. This insulating shroud 60 provides a first level of water seal protection to the inner components of the assembly and electrically insulates the user from outer shaft 55. Insulator bushing 35 and O-ring 52 provides secondary protection against water entering the radio via the control knob assembly. Shroud 60 also provides a shock absorbing effect, to prevent damage to the radio or the control knob if the radio is dropped, by virtue of its resiliency.

A movable switch contact 65 is adjacent the inner surface of the upper end of shroud 60. In one embodiment, the switch contact is a dome-like structure made of carbon impregnated silicone rubber or a similar conductive elastomeric material. In another embodiment, this movable contact or protuberance 65 is a conductive elastomeric button which is molded into insulating shroud 60. However, one skilled in the art will recognize that popple or snap-dome type switches, such as those manufactured by K. B. Denver Inc., 451 Oak Street, Fredrick, Colo. 80530, and the like could be readily substituted. In the preferred embodiment the insulating shroud 60 and movable contact 65 are dimensioned appropriately to hold movable contact 65 in place above inner shaft 10 and in contact with intermediate shaft 30. This movable switch contact 65 is actuated by depressing the top of insulating shroud 60. The upper end of resilient shroud 60 deforms and switch contact 65 is pressed against inner shaft 10 and intermediate shaft 30 at their upper ends forming a conductive path between the normally electrically isolated members.

As shown in FIGS. 1 and 3 a first conductive spring member 68, which is preferrably of tin plated berylium copper and shaped similar to a question mark is clipped around the lower portion of outer shaft 55 to make electrical contact therewith. This first conductive spring member 68 allows rotation of the control knob 5 while maintaining electrical contact with the outer shaft 55 and thus forms a slidable contact. A second conductive spring member 80 is similarly attached to the lower portion of inner shaft 10. In the preferred embodiment the lower portion of each of shafts 55 and 10 are appropriately dimensioned to allow the same type of spring member to be used in either place. The elongated end of these conductive spring members may be inserted in a printed circuit board and soldered therein to provide electrical connection to associated circuitry.

In operation, the potentiometer may be adjusted by rotating control knob 5 and when the upper end of the insulating shroud is deflected inward an electrical circuit is completed for as long as the shroud is held deflected to electrically connect inner shaft 10 with outer shaft 55. When released the shroud returns to its original shape and electrically interrupts that connection. If a current enters the first conductive spring member it is passed along the length of outer shaft 55 to clutch band 45. Clutch band 45 in turn passes the current along to the actuated movable switch contact 65 which in turn passes the current along to intermediate shaft 30. Intermediate shaft 30 then passes current along to inner shaft 10 which provides current to the second conductive spring member 80 which is connected to PC Board 85. The flanged out portion of insulating bushing 35 shown at is lower end prevents the first and second conductive spring members from comming in electrical contact during operation. Thus insulator bushing 35 forms electrical isolation for the whole momentary contact switch assembly along with secondary water seal protection and mechanical coupling.

In use, control knob assembly 70 would normally be attached to a control panel 90 and the lower portion of inner shaft 10 would mate to a potentiometer 20 which is also preferrably soldered to a circuit board 85 (FIG. 3). Assembly 70 would normally be inserted through an aperture in control panel 90. An O-ring 95 which is preferrably lubricated is installed between the control panel and the outer shaft 55 as shown in FIG. 1 in order to prevent water from entering the housing through the control panel 90. A retaining ring 100 preferrably made of stainless steel is clipped into a circumferrential slot 105 near the lower end of outer shaft 55 in order to retain it to the control panel 90 and prevent longitudinal displacement of the control knob 70 (and its associated shafts) relative to the control panel while allowing rotation.

The frictional coupling provided by clutch band 45 between intermediate shaft 30 and outer shaft 55 is adjusted to allow rotational slippage between those two shafts in the event that too much torque is applied to the control knob thereby endangering the mechanical and/or electrical integrity of the potentiometer. The preferred breakaway torque is greater than that required to readily turn the potentiometer shaft and less than that which will cause failure of the potentiometer. The potentiometer used in the preferred embodiment has a built in on/off switch at one end of its rotational range as is commonly known. The potentiometer 20 and its switch operate with a torque of less than 6 inch-ounces. The torque required to damage potentiometer 20 was found to be in excess of 40 inch-ounces. The clutching mechanism was therefore designed to "breakaway" in the range of approximately 12 to 30 inch-ounces. This "breakaway" torque is set by choosing the proper clutch material and adjusting the spring constant and dimensions thereof.

Assembly of the control knob is as follows. The opening in clutch band 45 is spread apart and the clutch band is clipped around slot 40 of intermediate shaft 30. O-ring 52 is stretched slightly and rolled into place in slot 50 of intermediate shaft 30. This sub-assembly is pressed into outer shaft 55 until firmly seated. O-ring 95 is rolled over the lower end of outer shaft 55 until it is in the uppermost circumferrential slot in outer shaft 55. Insulator bushing 35 is slipped in place over inner shaft 10. This combination is inserted through the bore in intermediate shaft 30 from the lower end and is firmly press-fitted into place to form a first sub-assembly. The insulating shroud 60 is then pulled into place over outer shaft 55 by slightly deforming the lower portion of the flexible shroud 60 outward until the outer shaft 55 penetrates the shourd's lower lip. The shroud 60 is then pushed downward until it snaps into place when it fully seats. This knob assembly 5 can then be interfaced to panel 90 as previously described. It should be noted that the knob assembly can be completely assembled prior to installation in panel 90.

Thus it is apparent that, in accordance with the invention, a method and apparatus that fully satisfies the objects, aims and advantages is set forth above. While the invention has been described in conjunction with specific embodiments, it is evident that many alternatives, modifications and variations will be apparent to those skilled in the art in light of the foregoing description. Accordingly, it is intended that the present invention embrace all such alternatives, modifications, and variations as fall within the spirit and broad scope of the appended claims.

We claim:

1. A rotatable waterproof control knob assembly including an integral momentary contact switch, comprising:

a conductive inner shaft having a longitudinal axis and an upper and a lower portion;

a conductive outer shaft concentric with said inner shaft and having an upper and a lower portion corresponding to said upper and lower portions respectively of said conductive inner shaft;

means for electrically isolating but mechanically coupling said inner and outer shafts to permit simultaneous concentric rotation of said inner and outer shafts about said longitudinal axis;

a flexible shroud having a top covering and sealing the upper portions of said inner and outer shafts to provide a water barrier for prevention of water entry between said inner and outer shafts at said upper portions of said inner and outer shafts; and switch contact means, located adjacent said shroud and said upper portions of said inner and outer shafts, for electrically coupling said inner and outer shafts together when the top of said shroud is flexed toward said upper portions of said inner and outer shafts;

whereby, said momentary switch may be actuated without longitudinal motion of said inner and outer shafts.

2. The control knob assembly of claim 1, further including a potentiometer and wherein the lower portion of said inner shaft is mechanically coupled to said potentiometer so that longitudinal rotation of said inner shaft adjusts said potentiometer.

3. The control knob assembly of claim 1, wherein said switch contact means includes a conductive elastomer positioned above the upper portions of the inner and outer shafts such that deformation of said shroud causes said elastomer to couple said inner and outer shafts electrically.

4. The control knob assembly of claim 3 wherein said shroud has an inner surface and said switch contact is a dome like structure adjacent said inner surface and concave when viewed away from said inner shaft.

5. The control knob assembly of claim 3, wherein:

said shroud is comprised of an electrically insulating elastomer; and said switch contact is a conductive elastomer attached to the inner surface of said shroud.

6. The control knob assembly of claim 1, wherein said electrically isolating but mechanically coupling means provides frictional coupling between said inner and outer shafts.

7. The control knob assembly of claim 6 wherein said electrically isolating but mechanically coupling means includes:

an intermediate shaft disposed between said inner and outer shafts;

an insulator bushing disposed between said intermediate shaft and said inner shaft to electrically isolate said shafts and prevent independent rotation thereof; and an electrically conductive clutch band disposed between said intermediate and said outer shafts providing frictional coupling between said inner and outer shafts.

8. The control knob assembly of claim 7, wherein said outer shaft may rotate independently of said inner shaft when sufficient torque is applied to said outer shaft as a result of slipping of said clutch band;

whereby, the potentiometer is protected from overtorquing damage by said slipping of said clutch band.

9. The control knob assembly of claim 8, wherein said switch contact means physically touches said inner shaft and said intermediate shaft to effect electrical coupling between said inner and outer shafts.

10. The control knob assembly of claim 9, further including first and second conductive spring members electrically contacting said inner and outer shafts respectively and adapted to allow rotation thereof.

11. A method for operating a multi-function control knob, wherein the knob comprises, a control knob having a shaft, an outer surface and a waterproof flexible shroud covering said outer surface, said flexible shroud having a deformable upper portion;

a potentiometer operatively coupled to said control knob so that rotation of said control knob varies the setting of said potentiometer;

a momentary contact switch adjacent said upper portion of said shroud;

the method of operating comprising the steps of;

rotating said control knob to vary the setting of said potentiometer; and deforming said upper portion of said flexible shroud inward to actuate said mementary contact switch without causing longitudinal motion of said control knob shaft.

* * * * *